US005562247A

United States Patent [19]

Roman

[11] Patent Number: 5,562,247

[45] Date of Patent: Oct. 8, 1996

[54] IRRIGATOR WITH AN OSCILLATING ARM

[75] Inventor: Gianfranco Roman, Pasiano, Italy

[73] Assignee: Claber S.p.A., Italy

[21] Appl. No.: 321,301

[22] Filed: Oct. 11, 1994

[30] Foreign Application Priority Data

Oct. 14, 1993 [IT] Italy ..... MI93A02175

[51] Int. Cl.[6] ..... B05B 3/16

[52] U.S. Cl. ..... 239/240; 239/381; 239/563

[58] Field of Search ..... 239/563, 98, 240–242, 239/237, 381, DIG. 1, 97, 98, 263, 566

[56] References Cited

U.S. PATENT DOCUMENTS

| | | | |
|---|---|---|---|
| 3,182,867 | 5/1965 | Barosko et al. | 239/563 X |
| 3,790,082 | 2/1974 | Poohard | 239/DIG. 1 X |
| 4,632,313 | 12/1986 | Rinkewich | 239/242 |
| 4,860,954 | 8/1989 | Alleman | 239/242 X |
| 5,457,825 | 10/1995 | Holtsnider | 239/98 X |

FOREIGN PATENT DOCUMENTS

| | | | |
|---|---|---|---|
| 0362558 | 4/1990 | European Pat. Off. . | |
| 0394653 | 10/1990 | European Pat. Off. . | |
| 2142262 | 1/1973 | France | 239/381 |
| 2607728 | 6/1988 | France . | |
| 1926735 | 12/1970 | Germany . | |
| 3119094 | 11/1982 | Germany | 239/242 |
| 542072 | 11/1977 | U.S.S.R. | 239/563 |

*Primary Examiner*—Kevin Weldon
*Attorney, Agent, or Firm*—Nixon & Vanderhye

[57] ABSTRACT

An irrigator comprises an oscillating arm (1) formed by a hollow cylinder provided with a longitudinal succession of holes (8) suitable for passage of an irrigation liquid. An operation unit (6) oscillates the arm about its own axis. A cylindrical sleeve (9) is inserted coaxially and rotatably in the oscillating arm, and has thereon at least one surface groove (11) for channeling the irrigation liquid whereby the irrigation liquid is emitted through the holes in the arm aligned with the surface groove. The sleeve has a terminal section (13) and a remaining section (12), and the groove (11) has a terminal groove section in the terminal section of the sleeve and a remaining groove section in the remaining section of the sleeve. The terminal section (13) of the sleeve is rotatable with respect to the remaining section (12) of the sleeve, to allow the terminal groove section to be staggered with respect to the remaining groove section for controlling the flow of irrigation liquid from the oscillating arm.

5 Claims, 2 Drawing Sheets

IRRIGATOR WITH AN OSCILLATING ARM

BACKGROUND

1. Field of the Invention

The present invention relates to an irrigator with an oscillating arm.

2. Related Art and Other Considerations

Irrigators for gardening are known that comprise a hollow arm provided with a longitudinal succession of holes for the passage of water that, issuing from a water supply point, flows inside the arm itself. The latter is made to oscillate round its own axis, for example by means of a unit with a turbine and means for transforming motion from rotatory to oscillatory, by the pressure of the water, so as to irrigate alternately portions of land located on opposite sides with respect to the irrigator. The total irrigated land area has a width corresponding to the length of the oscillating arm, and a length equal to twice the maximum distance covered by the jets of water issuing from the holes.

Irrigators are also known wherein the width of the irrigated area can be modulated by varying the length of the oscillating arm, by means of plugs, sliding along the same arm to cover up a desired number of holes, placed at the end of the arm.

The total irrigated land area depends, however, not only on the length of the oscillating arm, but also on the length of the jet issuing from the individual holes, that is essentially on the pressure of the water inside the arm. Such pressure is linked to the number of holes utilized in the oscillating arm, so that in arms of greater length and thus with more holes, diminishing the pressure of water inside the arm, would consequently diminish the length of the jet issuing from the holes, and no benefit in terms of the irrigated area would thus be obtained. For this reason in irrigators produced normally the oscillating arms do not have more than 18 holes.

A similar problem would be exhibited if, for an equal length of the oscillating arm, the distance between the holes were to be diminished so as to have a greater fineness in the distribution of the water: as for the previous case, the increase in the number of holes would determine a drop in the pressure of the water and thus a reduction in the length of the jet issuing from the holes themselves. If the pressure of water were to be reduced excessively, the irrigator would no longer be capable of carrying out its functions properly, since the area of irrigated land would be reduced to a small region surrounding the irrigator itself.

In view of the described state of the art, the object of the present invention is to provide an irrigator with an oscillating arm wherein the arm itself can have a high number of holes, so that it is possible to provide arms that are longer and/or with holes very close to one another, without it being subject to problems of drops of pressure of water and thus of a reduction in the area that can be irrigated.

SUMMARY

According to the present invention, such object is attained thanks to an irrigator with an oscillating arm, comprising an oscillating arm constituted by a hollow cylinder provided with a longitudinal succession of holes suitable for the passage of an irrigation liquid, and first means operated by said liquid suitable for determining the oscillation of the arm round its own axis, characterized in that it comprises a cylindrical sleeve inserted coaxially in said oscillating arm in a freely rotatable manner with respect to the arm itself and provided with at least one surface groove for the passage of the irrigation liquid, having a longitudinal shape suitable for determining the simultaneous opening of one part of the abovementioned holes with which the arm is provided, the remaining holes being obstructed by the sleeve, and second means operated by the irrigation liquid suitable for determining the relative rotation of the sleeve inside the arm for the opening in succession of different holes.

In a preferred embodiment, a terminal section of said sleeve is manually rotatable with respect to a remaining section of the sleeve, to allow one section of groove obtained on the surface of said terminal section to be staggered with respect to a section of groove obtained on the surface of the remaining section of sleeve and consequently to prevent the flow of irrigation liquid to a terminal section of the oscillating arm.

Thanks to the present invention, it is possible to provide an irrigator with an oscillating arm wherein the arm itself can have a high nunber of holes, in order to obtain irrigators both with arms having a high length (to increase the irrigated area of land) and with holes close to one another (to increase the degree of fineness in the distribution of the irrigation liquid), without in this way jeopardising the pressure of the irrigation liquid inside the oscillating arm and thus the length of the jets issuing from the holes themselves.

Moreover, thanks to the preferred embodiment of the invention, the irrigator can have a length that can be varied manually, to increase or decrease the area of irrigated land so as to adapt itself to the different needs.

BRIEF DESCRIPTION OF THE DRAWINGS

The features of the present invention will be made more evident by the following detailed description of two embodiments thereof illustrated as non-limiting examples in the enclosed drawings, wherein.

DETAILED DESCRIPTION OF THE DRAWINGS

Figure 2:
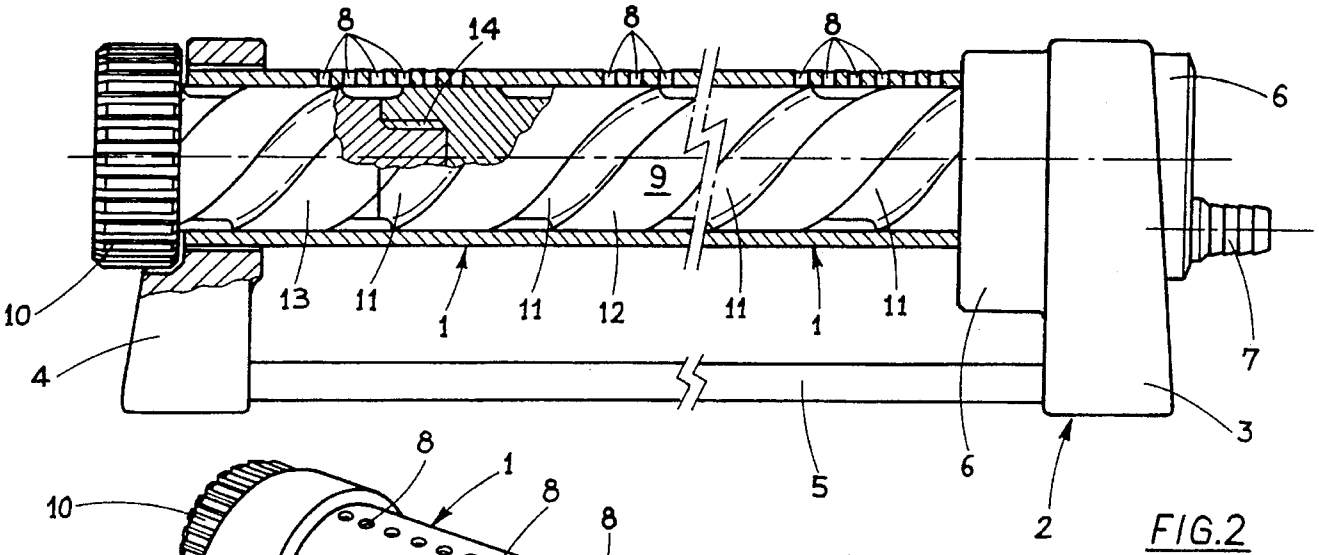
FIG. 2 is a longitudinal cross-section of the irrigator of FIG. 1, showing a first embodiment of the invention.
Figure 1:
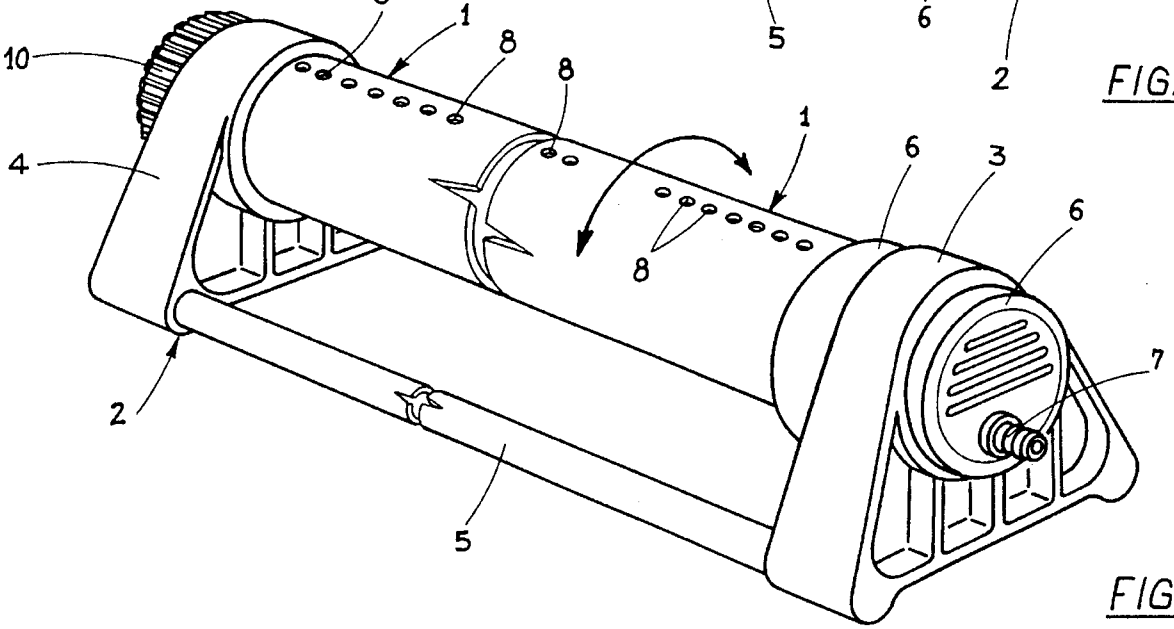
FIG. 1 is a perspective view of an irrigator with an oscillating arm.

As shown in FIGS. 1 and 2, an irrigator with an oscillating arm comprises an arm 1 rotatably held by a supporting base 2 comprising two vertical shoulders 3 and 4 linked by a pair of longitudinal bars 5. On the vertical shoulder 3 there is an operating unit 6 for moving the arm 1. For example operating unit 6 comprises a turbine that is made in a manner known to those skilled in the art, to rotate by the water fed through a pipe inserted on a fitting 7 and means for transforming the continuous rotatory motion of the turbine into an alternating oscillating motion of the arm 1 round its own axis.

The arm 1 is hollow internally and it is provided with a longitudinal succession of holes 8 for the passage of the water.

Inside the arm 1 there is rotatably inserted a cylindrical sleeve 9 with a diameter substantially coincident with the internal diameter of the arm 1. The sleeve 9 consists of two separable elements 12 and 13, the first of which has a greater length than the second, coupled by means of an elastic notched coupling 14 see FIG. 3, for example. The element 13 having a shorter length is integral with a hand grip 10 protruding from the vertical shoulder 4, and it can be rotated, by manually operating the hand grip 10, with respect to the element 12 having a greater length, for the reasons that will be explained later. The element 12 having a greater length has associated with it means known in themselves located inside the operating unit 6 that allow its rotation relative to the arm 1 under the thrust exerted by the flow of water.

Figure 3:
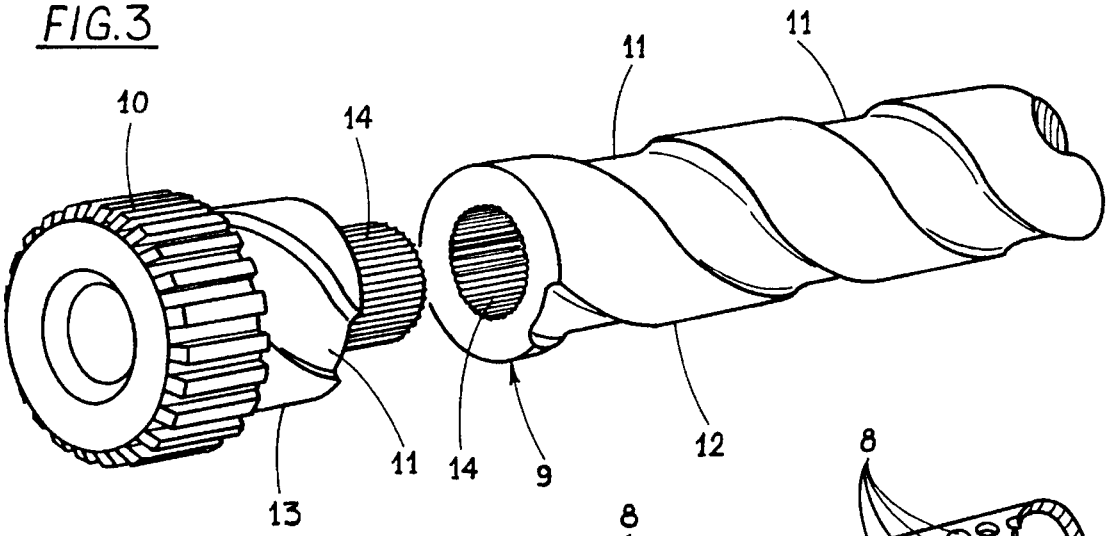
FIG. 3 is a perspective view of a sleeve of the irrigator of FIG. 2.
Figure 4:
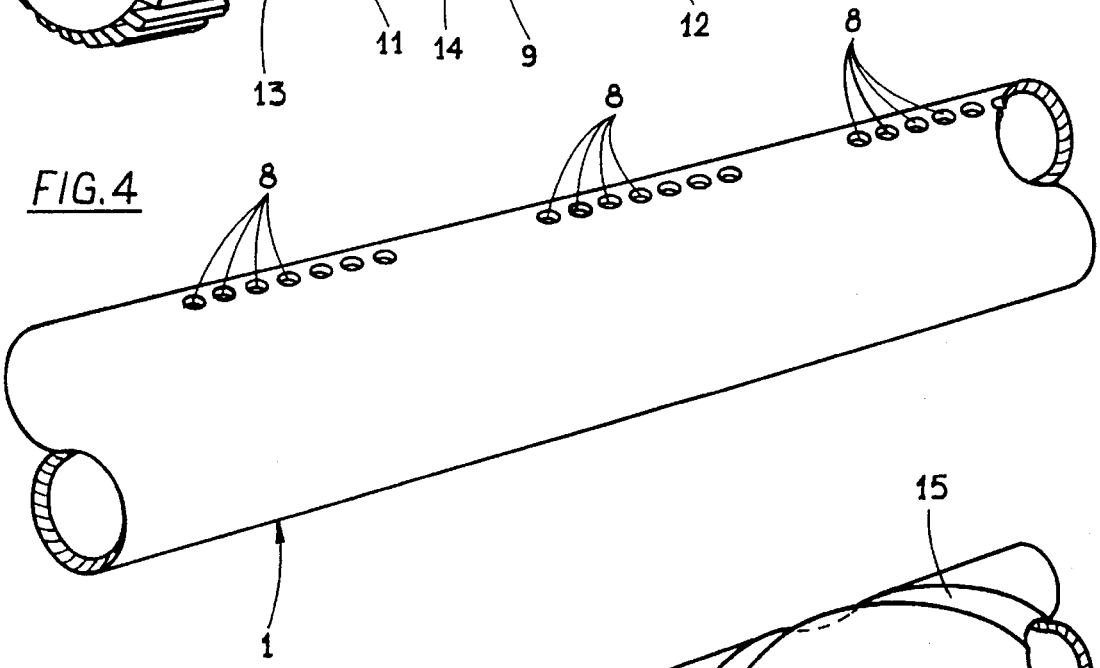
FIG. 4 is a perspective view of an oscillating arm of the irrigator of FIG. 1.

In a first embodiment of the invention, shown in FIGS. 2 and 3, there is a helical groove 11 on the external surface of the sleeve 9.

Once the irrigator has been connected to a water supply point (say, a cock), the pressure of the water arriving through the fitting 7, thanks to the means placed in the operating unit 6, determines the oscillation of the arm 1 round its own axis and the rotation of the sleeve 9 with respect to the arm 1. The flow of water then passes into the helical groove 11 and flows along the groove 11, issuing from the arm 1 through those holes 8 that, at any given instant, are superimposed over the groove 11, while the remaining holes 8 are obstructed by the external surface of the sleeve 9. The rotation of the sleeve 9 with respect to the arm 1 determines the opening of new holes 8, and the closing of those that were open during the preceding instant. In this way the holes 8 can be very close to one another, to ensure a greater degree of fineness in the distribution of water, without jeopardising the pressure of the water inside the arm 1, as only some of the holes 8 are open at any one time.

If the element 13 of the sleeve 9, by means of the hand grip 10, is rotated manually with respect to the element 12, the two sections of the helical groove 11 obtained on said elements 12 and 13 of the sleeve itself are staggered, thus determining the interruption of the flow of water to the terminal section of the arm 1; in this way it is possible to modulate the length of the arm 1 itself, in order to vary the irrigated area of land.

Figure 5:
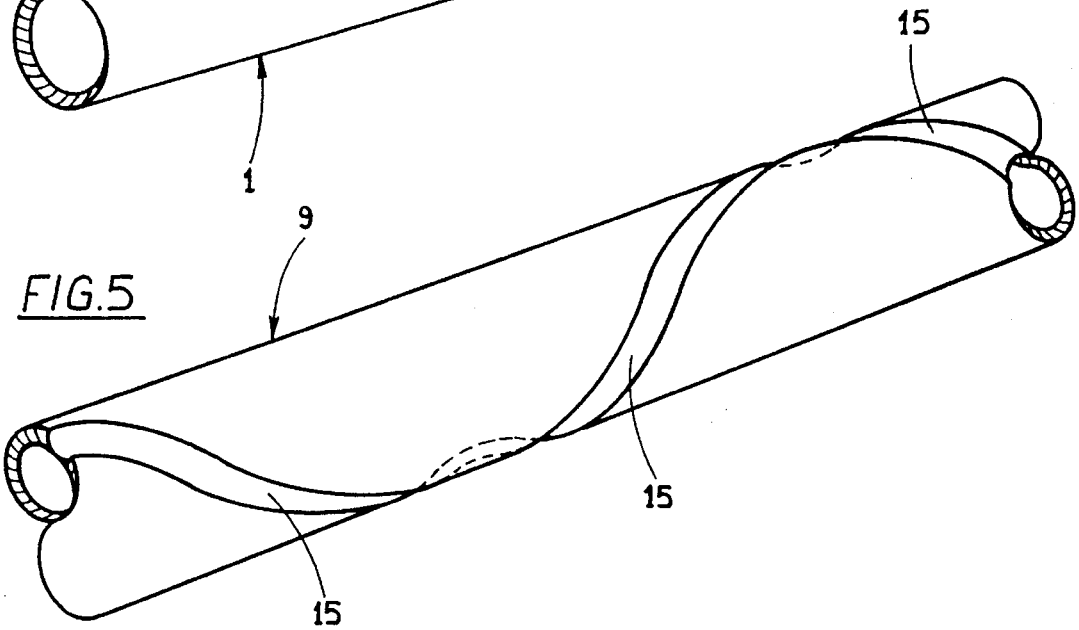
FIG. 5 is a perspective view of a part of a sleeve according to a second embodiment of the invention.

In a second embodiment, shown in FIG. 5, on the surface of the sleeve 9 there is a groove 5 having a shape other than helical, but in any case capable of determining the alternating opening and closing of groups of holes 8 of the arm 1. More precisely, the groove 15 consists of alternate sections of a right-hand and a left-hand helix placed in succession and connected together.

Grooves with yet another different shape on the surface of the sleeve 9 allow the attainment of the same purpose as the ones described as an example, and fall in any case within the scope of the present invention.

I claim:

1. An irrigator comprising:

an oscillating arm, the oscillating arm comprising a hollow cylinder provided with a longitudinal succession of holes suitable for passage therethrough of an irrigation liquid;

an operation unit operable by the irrigation liquid suitable for oscillating the arm about its own axis;

a cylindrical sleeve inserted coaxially and rotatably in said oscillating arm, the sleeve having at least one surface groove thereon for channeling the irrigation liquid whereby the irrigation liquid is emitted through holes in the arm aligned with the surface groove, the sleeve having a terminal section and a remaining section, the groove having a terminal groove section in the terminal section of the sleeve and a remaining groove section in the remaining section of the sleeve;

wherein the terminal section of said sleeve is rotatable with respect to the remaining section of the sleeve, to allow the terminal groove section to be staggered with respect to the remaining groove section for controlling the flow of irrigation liquid from the oscillating arm.

2. An irrigator according to claim 1, wherein said groove has a helical shape.

3. An irrigator according to claim 1, wherein said groove is formed whereby the groove extends for along a first portion of the surface of the sleeve as right-hand helix and along an adjacent second portion of the surface of the sleeve as a left-hand helix.

4. An irrigator according to claim 1, wherein said terminal section of the sleeve is coupled to said remaining section of the sleeve by means of an elastic notched coupling, and is integral with a hand grip to allow its manual rotation with respect to the remaining section.

5. An irrigator according to claim 1, further comprising means operable by the irrigation liquid for determining a relative location of the sleeve inside the arm.

* * * * *